US007850033B2

(12) United States Patent
Thorstensen-Woll

(10) Patent No.: US 7,850,033 B2
(45) Date of Patent: Dec. 14, 2010

(54) SYNTHETIC TWO-PIECE INDUCTION SEAL PRODUCTS

(75) Inventor: Robert William Thorstensen-Woll, Barrie (CA)

(73) Assignee: Selig Sealing Products, Inc., Forrest, IL (US)

( * ) Notice: Subject to any disclaimer, the term of this patent is extended or adjusted under 35 U.S.C. 154(b) by 489 days.

(21) Appl. No.: 11/938,881

(22) Filed: Nov. 13, 2007

(65) Prior Publication Data

US 2008/0121605 A1 May 29, 2008

Related U.S. Application Data

(60) Provisional application No. 60/867,545, filed on Nov. 28, 2006.

(51) Int. Cl.
*B65D 41/00* (2006.01)
*B65D 51/00* (2006.01)

(52) U.S. Cl. ..... 220/359.3; 215/232

(58) Field of Classification Search ..... 220/359.4, 220/359.3, 359.1, 254.1, FOR. 186, FOR. 203, 220/200; 215/341, 258, 232, 316, 200; 53/476, 53/396; 428/348, 346, 344; D9/434; *B65D 77/20, B65D 77/00*

See application file for complete search history.

(56) References Cited

U.S. PATENT DOCUMENTS 2,620,939 A * 12/1952 Weisgerber ..... 215/347
3,901,240 A * 8/1975 Hoey ..... 604/364
4,503,123 A * 3/1985 Ou-Yang ..... 428/349
4,596,338 A * 6/1986 Yousif ..... 215/232
4,684,554 A * 8/1987 Ou-Yang ..... 428/34.2
4,733,786 A * 3/1988 Emslander ..... 215/230
4,772,650 A 9/1988 Ou-Yang
4,818,577 A 4/1989 Ou-Yang
4,917,949 A * 4/1990 Yousif ..... 428/349
4,930,646 A * 6/1990 Emslander ..... 215/232
5,265,745 A 11/1993 Pereyra et al.
5,381,913 A 1/1995 Peeters
5,637,396 A * 6/1997 Sato et al. ..... 428/349
5,669,521 A 9/1997 Wiening et al.

(Continued)

FOREIGN PATENT DOCUMENTS

WO 2006/099260 A1 9/2006

OTHER PUBLICATIONS

PCT/US2007/058370—International Search Report. dated Apr. 17, 2008.

(Continued)

*Primary Examiner*—Anthony Stashick
*Assistant Examiner*—Robert J Hicks
(74) *Attorney, Agent, or Firm*—Fitch, Even, Tabin & Flannery

(57) ABSTRACT

A two-piece induction seal for use in creating clean, safe, and secure inner seals on containers having a monolayer plastic formed from synthetic fibers with stable pore dimensions for fluid permeability while retaining dimensional stability for compression. An inductive innerseal membrane is provided having a first side and a second side thereof, with an adhesive layer at the first side of the membrane. The second side of the membrane is detachably bound to the synthetic material with a wax layer. The synthetic material is further suitable for absorbing substantially all of said wax layer when said wax layer is in liquid form.

20 Claims, 2 Drawing Sheets

U.S. PATENT DOCUMENTS

| | | | | |
|---|---|---|---|---|
| 5,712,042 | A | 1/1998 | Cain | |
| 5,871,112 | A | 2/1999 | Giles et al. | |
| 5,915,577 | A * | 6/1999 | Levine | 215/232 |
| 6,082,566 | A * | 7/2000 | Yousif et al. | 215/232 |
| 6,131,754 | A | 10/2000 | Smelko | |
| 6,277,478 | B1 | 8/2001 | Kurita et al. | |
| 6,378,715 | B1 * | 4/2002 | Finkelstein et al. | 215/341 |
| 6,902,075 | B2 | 6/2005 | O'Brien et al. | |
| 2003/0196418 | A1 * | 10/2003 | O'Brien et al. | 53/490 |
| 2006/0151415 | A1 | 7/2006 | Smelko et al. | |

OTHER PUBLICATIONS

PCT/US207/058370—Written Opinion of the International Searching Authority. dated Apr. 17, 2008.

PCT/US2007/058370-Notification of Transmittal of the International Search Report and the Written Opinion of the International Searching Authority or the Declaration.Apr. 17, 2008.

* cited by examiner

FIG. 1
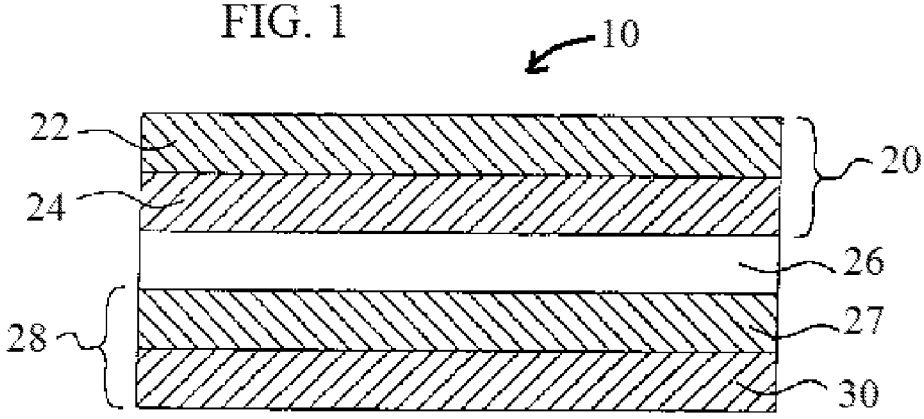
Prior Art
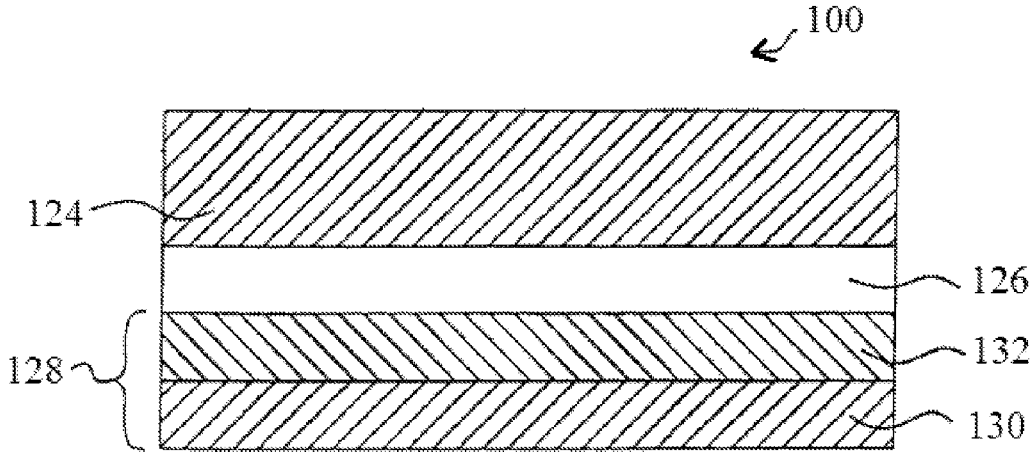
FIG. 2

SYNTHETIC TWO-PIECE INDUCTION SEAL PRODUCTS

CROSS-REFERENCE TO RELATED APPLICATION

This application claims priority pursuant to 35 U.S.C. 119 (e) to U.S. Provisional Application No. 60/867,545, filed on Nov. 28, 2006 which is incorporated herein by reference in its entirety.

FIELD OF THE INVENTION

The present invention relates to two piece induction container seals, and more particularly to novel synthetic two piece induction seal products.

BACKGROUND OF THE INVENTION

A variety of two-piece induction seals have been developed. Seal products have application in the closure industry. The seal generally includes a compressing agent (e.g., a thickness of pulpboard or layers of synthetic foam) and an induction membrane layer (e.g., foil), with a wax layer between them to keep them in place during processing. The membrane layer further has an adhesive layer on its bottom surface which is generally a heat-activated adhesive layer. During bottle closure operations, the seal product is placed between the rim or other opening of the filled container and the cap. When energy is applied, the induction membrane layer becomes heated, thereby melting the wax and activating the adhesive. The result is the conversion of the one-piece unit into two pieces, with the adhesive layer bonding the membrane layer to the rim, and the melted wax being absorbed by paper, the compressing agent or an absorbing synthetic polymer therewith. The compressing agent generally remains lodged in the inner portion of the cap or other closure device.

In common application, the compressing agent is a pulpboard material. This organic material is suitable for absorbing the melted wax. However, this system presents numerous disadvantages. The pulpboard becomes a source of paper dust which can contaminate the contents of the container. In another alternative, the foil layer is covered with a paper layer. A wax layer initially binds the compressing agent to the paper layer of the foil. When energy is applied to the unit, the wax melts and is absorbed by the paper on the foil layer, rather than being absorbed into the synthetic foam compressing agent. Eventually, this can cause the paper layer to seal to the synthetic foam. Additionally, pulpboard or paper are moisture sensitive and can become distorted and altered by fluctuations in humidity levels. Moreover the wax-filled pulpboard can also serve as a growth medium for bacteria and other biological contaminants. Alternative seal structures have been developed to attempt to overcome these disadvantages. In one such alternative, the compressing agent is made of a synthetic foam material which is initially bound to a foil layer by a starch layer. Application of energy heats and transforms the starch layer, breaking the bond between the foam and the foil.

In still another alternative, the wax or starch layer is replaced by a pressure-sensitive adhesive. This adhesive effectively binds the compressing agent, be it pulpboard or synthetic foam, to the foil layer. The process of opening the cap imparts a shearing force which breaks that bond allowing the container to be opened. A principle disadvantage of this device is that the adhesive layer which is present on the surface of the compressing agent remains tacky. As a result, materials, such as pills or other contents of the container, dirt, and other debris, can become affixed to the inner surface of the cap. The prior art does not solve the traditional problems of contamination, because the paper layer on the foil can continue to serve as a biological growth medium. In addition, the paper layer can present structural issues by delaminating from the foil layer and by expanding and contracting due to changes in humidity. The starch residue remaining on the synthetic foam can continue to serve as a bacterial growth medium.

Unipac Corporation has developed a two-piece induction seal which uses as the compressing agent a synthetic foam material with a synthetic polymer underlayer made of TYVEK™ from DuPont. This seal has been found to solve some of the problems described above, but the TYVEK™ synthetic polymer does not present a uniform absorbing surface due to porosity dimensional instability. The limitations of TYVEK™ can be attributed to the inconsistent fiber composition related to the flash spinning manufacture method used in its production that results in long fiber content. As a result, wax residues remain on the surface of the TYVEK™ layer after induction sealing causing variable behavior. In some instances the TYVEK™ layer melts, creating difficulty in opening the container.

A further developed two-piece induction seal, described in U.S. Pat. No. 6,131,754 to Smelko for "Synthetic two-piece induction seal" issued Oct. 17, 2000, uses a synthetic foam layer material as the compressing agent with a laminated layer of TESLIN™ synthetic polymer underlayer made of an absorbing synthetic polymer. However, this prior art design was not commercialized due to the inability to maintain adequate adhesion after being wax laminated. TESLIN™ is composed of a very high molecular weight polyolefin phase and a filler phase that is primarily silica. During manufacturing of TESLIN™ mineral oil is used to incorporate the silica into the matrix of the polyolefin. This process gives the TESLIN™ the porosity that is an integral part of the films design. Unfortunately a small amount of residual mineral oil remains in the film's matrix after processing. It was determined that the mineral oil would migrate out of the film and dissolve the microcrystalline wax used to laminate the 2 piece structure resulting in premature separation of the laminate. The compatibility of TESLIN™ with solvents and reagents reflects its dual composition of polyolefin and silica. Bases with a pH level of less than approximately 8.5 have little effect on the dimensions of TESLIN™. Alkali bases (e.g. sodium or potassium hydroxide) at higher pH levels or elevated temperatures will attack the silica filler and lead to shrinkage as the silica is removed from the sheet. Elevated temperatures may also lead to dimensional changes with weaker bases, which is of concern in a variety of end uses. For example alkali bleach that is typically pH 9.5 and above would be considered a typical package requirement for secondary sealing, as produced in the design, and would be of concern due to the described dimensional instability issues.

SUMMARY OF THE INVENTION

With the induction membrane detachably bound using a wax layer, the present invention overcomes the problems of the prior art in an efficient and cost-effective manner. Through the use of a synthetic compressing agent absorbing material comprising a monolayer plastic formed from synthetic fibers with stable pore dimensions for fluid permeability while retaining dimensional stability for compression, the resulting cap inner seal presents a clean, safe and structurally sound product. As such the synthetic material may be formed with highly fibrillated polyolefin synthetic pulp fiber for uniform dimensional stability for compression with stable pore dimensions for fluid permeability which substantially completely absorbs the wax, and does not create debris that could otherwise contaminate the contents of the container.

Briefly summarized, the present invention relates to a two-piece induction seal having a synthetic compressing agent absorbing material. The synthetic material comprises a monolayer plastic formed from synthetic fibers with stable pore dimensions for fluid permeability while retaining dimensional stability for compression. An inductive innerseal membrane is provided having a first side and a second side thereof, with an adhesive layer at the first side of the membrane. The second side of the membrane is detachably bound to the synthetic material with a wax layer. The synthetic material is further suitable for absorbing substantially all of said wax layer when said wax layer is in liquid form. Preferably, the synthetic compressing agent absorbing material is a monolayer polymer formed from highly fibrillated polyolefin synthetic pulp fiber having dimensional stability for compression with stable pore dimensions for fluid permeability. The invention further includes containers which have such two-piece induction seals.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

FIG. 1 is a cross-sectional view of prior art two-piece induction seal;

FIG. 2 is a schematic cross-sectional view of a two-piece induction seal product in accordance with the present invention.

DETAILED DESCRIPTION OF THE PREFERRED EMBODIMENT

Figure 3:
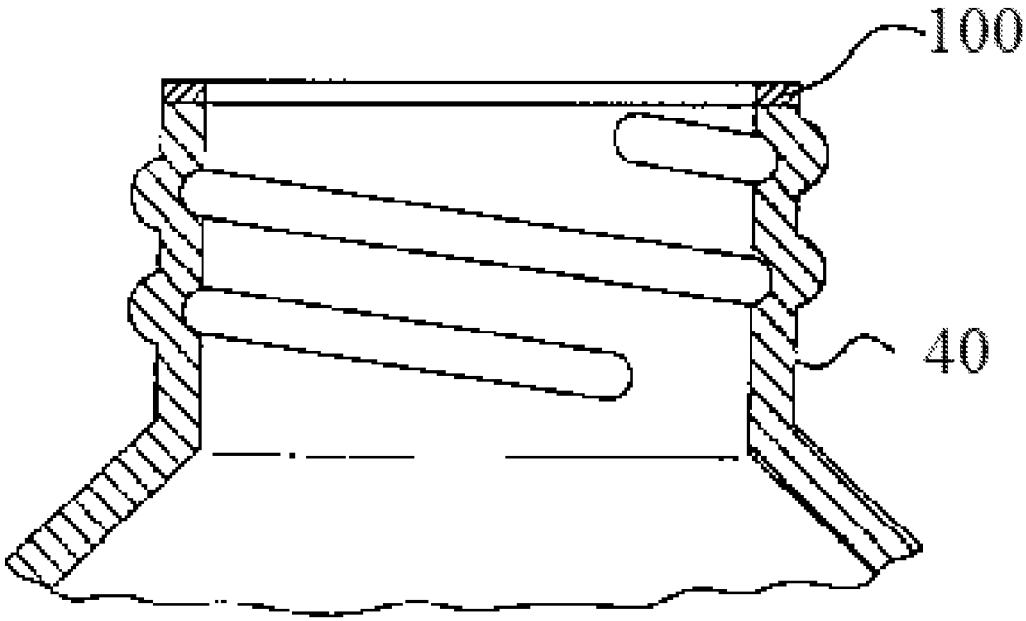
FIG. 3 is a schematic cross-sectional view of the rim opening of a container to be sealed in combination with a two-piece induction seal in accordance with an embodiment of the present invention.

Prior art FIG. 1 schematically represents the two-piece induction seal 10, in cross-section, described in U.S. Pat. No. 6,131,754 to Smelko for "Synthetic two-piece induction seal" issued Oct. 17, 2000. The described seal 10 comprises a compressing agent 20, which is formed of an upper layer of synthetic foam 22 and a lower layer of synthetic polymer 24, a wax layer 26 and an inductive membrane layer 28 including a metallic foil 27, preferably aluminum foil, with a lower adhesive layer 30. The synthetic foam layer 22 of the compressing agent 20 may be formed of a material with a suitable compression factor comparable to pulpboards of the type traditionally used in induction seals, e.g., coextruded low density polyethylene (LDPE), low density polyethylene (LDPE), polypropylene (PP) and polystyrene (PS). The features of the prior art compressing agent 20 and the foam layer 22 respectively comprise a synthetic foam layer material as the compressing agent and a laminated layer of TESLIN™ synthetic polymer underlayer made of an absorbing synthetic polymer.

FIG. 2 schematically represents a two-piece induction seal 100 of the present described embodiment of the invention, illustrated in cross-section. The seal product 100 comprises a monolayer synthetic compressing agent absorbing material 124, a wax layer 126 and an inductive membrane layer 128 with a lower adhesive layer 130, the membrane layer 128 is comprised of a metallic foil 132, preferably aluminum foil. FIG. 3 schematically represents a cross-section of the rim or opening 40 of a container to be sealed in combination with seal 100.

The synthetic compressing agent absorbing material 124 is formed of a material with a suitable compression factor comparable to pulpboards of the type traditionally used in induction seals. The synthetic material 124 selected for use should have a sufficient absorbency level, suitable pore volume and structure to absorb substantially all of the wax used in the seal. The dimensions of the synthetic compressing agent absorbing material 124 will vary according to the application and the size of the opening of the container and size and construction of the closure being used. Given these parameters, selection of suitable materials and determination of appropriate dimensions of the synthetic material 124 is within the ability of one skilled in the art.

The elements of the induction seal, as described from top (cap end) to bottom (rim end), are assembled in the form of a monolayer plastic formed from synthetic fibers (the synthetic compressing agent absorbing material 124), the wax layer 126 and the induction membrane layer 128 with the adhesive layer 130. Embodiments of the inventions herein are described in basic terms in relation to the two piece induction seal products including the foil/sealing layer wax laminated to a secondary liner and the like, but are further applicable to other types of two piece structures such as Top Tab™ or Lift N Peel™ liners which can be manufactured into two piece liners using the described technologies, etc. Accordingly, a piece of the induction seal product 100 is placed above the opening 40 of the filled container by suitable means, the opening 40 is then generally covered with its cap or other closure for the container. The filled, capped container is then exposed to an external energy source. The energy is absorbed by the induction membrane layer 128 which becomes heated, thereby melting the wax layer 126 and activating (or, at least, not deactivating) the adhesive layer 130. The induction membrane layer 128 becomes affixed to the rim or opening 40 of the container, while the liquid wax is substantially entirely absorbed by the synthetic compressing agent absorbing material 124.

This manufacturing process is carried out by conventional means using techniques and equipment readily available in the industry. More specifically in the described embodiments, the synthetic compressing agent absorbing material 124 comprises the monolayer plastic formed from synthetic fibers with stable pore dimensions for fluid permeability while retaining dimensional stability for compression. As described the synthetic compressing agent absorbing material 124 may comprise a monolayer polymer formed from highly fibrillated polyolefin synthetic pulp fiber having dimensional stability for compression with stable pore dimensions for fluid permeability, such as FYBREL™. More specifically in the described embodiments, during the manufacturing process, the external energy is absorbed by the aluminum foil 132 of the induction membrane layer 128 which becomes heated, thereby melting the wax layer 126 and activating the heat-activated adhesive layer 130. The aluminum foil layer 132 becomes affixed to the rim 40 of the synthetic compressing agent absorbing material 124.

Avoiding ink adhesion or ink transfer susceptibly concerns during the induction sealing process is also advantageous through the use of the monolayer plastic formed from synthetic fibers (the synthetic compressing agent absorbing material 124), over that of the pulp board during the induction sealing process. Whereas typically inks used to print the foil surface of induction liners have poor adhesion and are susceptible to transfer to the pulp board during the induction sealing process. The ink transfer occurs most predominantly in the land region of the seal where there is the most pressure and heat. The transfer is the result of the composition of the ink which is limited to food grade inks. It has been noted that ink transfer is not as prevalent when using the monolayer plastic synthetic material 124 in place of pulp board. This is related to the surface energy of the polymer fibers. Polymers are usually treated to increase the surface energy and promote adhesion of coatings and inks. In its natural state the synthetic material 124 does not promote good ink adhesion and therefore transfer of ink from the liner to its surface.

FYBREL™, Mitsui chemical provides a fibrillated polyolefin short fiber. However FYBREL™ has the same fibrillar form, high specific surface area, and drainage factor, as natural pulp which has been fibrillated resulting in controlled porosity. The monolayer FYBREL™ board presents many advantages in that the separation technology used to attain the separation required in two piece products remains wax lamination and absorption during the induction process. FYBREL™ may be provided as HDPE, PP, PET, NYLON or combinations thereof, or may be provided as 100% polymeric synthetic material such as polyethylene or polypropylene, or various compositions containing a certain percentage of paper components. According to SEM (Scanning Electron Microscopic) photographs, FYBREL™ non-woven are intertwined with each other or with blended synthetic fibers, and all fibers are well uniformly packed in space. Due to this uniform structure FYBREL™ shows sharp pore distribution, resulting in improved controllability of air/moisture permeation. This uniform structure of FYBREL™ adequately replaces pulp board in otherwise traditional two piece product offerings, manufacturable using the FYBREL™ technology in place of pulp board. Two products, e.g., include (1) Safe Gard™ 100 facing laminated to FYBREL™ 300U, and (2) Top Tab™ 562 laminated to FYBREL™ 300U. Such materials were tested in the lab under various induction settings, e.g., with roll samples of the 300 gsm FYBREL™ and 210 gsm. It was found that the structures performed well and demonstrated induction sealing windows that would be well suited for induction sealing applications.

As a polyolefin based polymer, FYBREL™ melts when exposed to the induction heating process. The most heat is generated in the land area or rim region of the container. The melt point of the polymer is about 125° C., well above the melt point of the described wax used to bond the material. After the wax has been absorbed, the FYBREL™ liner melts and forms a continuous non porous barrier in the land area, thereby improving the barrier properties it promotes as a secondary liner. Both samples produced demonstrated good adhesion and die punch-ability. FYBREL™ sheet can be manufactured that would be greater than 10 mil in thickness, and preferably 20 or 30 mil sheets or greater of FYBREL™ to replace pulp board. This eliminates the need to involve multiple lamination stages, and ideally as pulp board presents absorbing material including desired re-seal compressing agent characteristics due to the compressibility duplicated using monolayer FYBREL™, providing the loftiness of pulpboard and adequate resealabilty at the required thickness specifications.

The induction seal 100 comprises a wax layer 126 which serves to bind the synthetic compressing agent absorbing material 124 to the membrane layer 128. The wax layer 126 may comprise any suitable wax material which will melt within the temperature range to which the induction seal 100 is to be subjected. In general, the application of energy to the induction seal 100 within the container heats the induction membrane layer 128 to a temperature in the range from about 350 to about 450° F.; preferably about 450° F. The wax layer 126 should be comprised of a material with a melting point less than or equal to the highest sustained temperature of the induction membrane 128 when that membrane is subjected to an energy source during the sealing process. In addition, the volume or thickness of the wax layer 126 should be selected such that substantially all of the wax will melt during the manufacturing process. Preferably, the wax layer 126 has a thickness of 0.5 to 0.7 mm; more preferably 0.5 to 0.6 mm. The wax thickness in accordance with the present described embodiment defines wax content as per wax weight, e.g., a total wax weight is 12.0 to 15.0 g/m$^2$; preferably about 13.5 g/m$^2$. After the total wax is applied during the process, a certain quantity of the applied wax is driven by heat into the pulp board. This is referred to as the wax distribution. Advantageously a wax weight of approximately 5.0 g/m$^2$ is impregnated into the secondary pulp liner, leaving 8.5 g/m$^2$ of wax distributed between the foil induction liner and the pulp board. For example, the wax layer 126 may comprise a blend of paraffin and microcrystalline waxes. More particularly, the wax layer 126 may comprise a blend of paraffin wax and microcrystalline wax wherein the proportion of microcrystalline wax used in the wax layer is adjusted to provide the wax layer being formulated to enhance the ability of the wax to be absorbed by the pulp board or secondary liner for use with the desired porosity. Alternatively, the wax layer 126 may comprise microcrystalline wax modified with other polymeric additives to enhance its bonding properties. For instance, the wax layer 126 may comprise microcrystalline wax modified with at least one of ethylene vinyl acetate and polyisobutylene. Given these parameters, selection of suitable materials and determination of appropriate dimensions of the wax layer 126 is within the ability of one skilled in art.

The induction membrane layer 128 forms a seal over the rim or opening 40 of the container and comprises a material which will become heated by induction when exposed to an external energy source. The membrane layer 128 further comprises an adhesive layer 130 on its bottom surface which affixes the membrane layer 128 to the rim or opening 40 of the container. In a preferred embodiment, the membrane layer 128 is comprised of a metallic foil 132, preferably aluminum foil. In one embodiment, the membrane layer 128 comprises aluminum foil with a thickness of 0.5 to 1.5 mil; preferably about 1 mil. The thickness of the membrane layer 128 for a given application may be determined by one skilled in the art based on the characteristics of the material used and the size and other characteristics of the opening and container being sealed.

The adhesive layer 130 affixes the induction membrane layer 128 to the rim or opening 40 of the container. The adhesive layer 130 is applied to the surface of the membrane layer 128 opposite that which contacts the wax layer 126; as referred to herein as the bottom surface of the membrane layer 128. In a preferred embodiment, the adhesive layer 130 is comprised of a heat-activated polymer, such that the heat of induction generated during the manufacturing process is sufficient to activate the adhesive and to affix the membrane layer 128 to the rim or opening 40. Suitable adhesives for use include, but are not limited to, polyethylene, polypropylene, polyethylene terephthalate, ethylene vinyl acetate and polystyrene.

From the foregoing, it can be seen that there has been provided features for improved two-piece induction seal products. While a particular embodiment of the present invention has been shown and described, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description and accompanying drawings is offered by way of illustration only and not as a limitation. The actual scope of the invention is intended to be defined by subsequent claims when viewed in their proper perspective based on the prior art.

What is claimed is:

1. A two-piece induction seal product comprising:

a synthetic compressing agent absorbing material, said synthetic material comprising a monolayer plastic formed from intertwined synthetic fibers;

a wax layer;

an adhesive layer;

an inductive innerseal membrane having a first side and a second side thereof, with the adhesive layer at the first side of said membrane and the second side of said membrane being detachably bound to said synthetic material with said wax layer; and said intertwined synthetic fibers being further suitable for absorbing substantially all of said wax layer when said wax layer is in liquid form.

2. A product as recited in claim 1, wherein said synthetic material comprises a polymer comprising highly fibrillated fiber having dimensional stability for compression.

3. A product as recited in claim 2, wherein said synthetic material comprises a polymer comprising polyolefin synthetic pulp.

4. A product as recited in claim 3, wherein said synthetic material comprises polyethylene.

5. A product as recited in claim 3, wherein said synthetic material comprises polypropylene.

6. A product as recited in claim 3, wherein said synthetic material comprises a thickness greater than 10 mil.

7. A product as recited in claim 1, wherein the wax layer comprises a paraffin wax.

8. A product as recited in claim 7, wherein the wax layer further comprises an additive which enhances the bonding properties of the wax layer.

9. A product as recited in claim 1, wherein the wax layer comprises a microcrystalline wax.

10. A product as recited in claim 9, wherein the wax layer further comprises an additive which enhances the bonding properties of the wax layer.

11. A product as recited in claim 1, wherein the inductive innerseal membrane comprises a metal membrane.

12. A product as recited in claim 11, wherein the metal membrane comprises aluminum foil with the adhesive layer comprising a heat-activated polymer.

13. A two-piece induction seal product comprising:

a synthetic compressing agent absorbing material comprising a monolayer polymer formed from intertwined highly fibrillated polyolefin synthetic pulp fibers;

a wax layer;

an adhesive layer;

an inductive innerseal membrane having a first side and a second side thereof, with the adhesive layer at the first side of said membrane and the second side of said membrane being detachably bound to said synthetic material with said wax layer; and said intertwined synthetic fibers being further suitable for absorbing substantially all of said wax layer when said wax layer is in liquid form.

14. A product as recited in claim 13, wherein the inductive innerseal membrane comprises aluminum foil with the adhesive layer comprising a heat-activated polymer.

15. A container comprising:

a rim;

a cap capable of being seated on the rim; and a seal comprising a synthetic compressing agent absorbing material capable of being situated between said cap and said rim, said synthetic material comprising a monolayer plastic formed from intertwined synthetic fibers;

a wax layer;

an adhesive layer;

an inductive innerseal membrane having a first side and a second side thereof, with the adhesive layer at the first side of said membrane and the second side of said membrane being detachably bound to said synthetic material with said wax layer; and said intertwined synthetic fibers being further suitable for absorbing substantially all of said wax layer when said wax layer is in liquid form.

16. A container as recited in claim 15, wherein energy applied to said inductive innerseal membrane causes said membrane to become heated, causing said wax layer to melt and to be substantially entirely absorbed into said synthetic material.

17. A container as recited in claim 15, wherein said synthetic material comprises a polymer comprising highly fibrillated fiber having dimensional stability for compression.

18. A container as recited in claim 17, wherein said synthetic material comprises a polymer comprising polyolefin synthetic pulp.

19. A container as recited in claim 18, wherein said synthetic material comprises a thickness greater than 10 mil.

20. A container as recited in claim 15, wherein the inductive innerseal membrane comprises aluminum foil with the adhesive layer comprising a heat-activated polymer.

* * * * *